United States Patent [19]

Fukuroi

[11] Patent Number: 4,512,063

[45] Date of Patent: Apr. 23, 1985

[54] BUTTON

[75] Inventor: Takeo Fukuroi, Uozu, Japan

[73] Assignee: Nippon Notion Kogyo Co., Ltd., Tokyo, Japan

[21] Appl. No.: 521,339

[22] Filed: Aug. 8, 1983

[30] Foreign Application Priority Data

Aug. 11, 1982 [JP] Japan ..... 57-121754[U]

[51] Int. Cl.[3] ..... A44B 1/42; A44B 17/00

[52] U.S. Cl. ..... 24/94; 24/95; 24/96; 24/113 R; 24/689

[58] Field of Search ..... 24/94, 95, 92, 90 B, 24/93, 96, 113 R, 113 MP, 692, 689, 703

[56] References Cited

U.S. PATENT DOCUMENTS

| | | | |
|---|---|---|---|
| 437,003 | 9/1890 | Shipley | 24/95 |
| 459,483 | 9/1891 | White | 24/95 |
| 631,212 | 8/1899 | Hormann | 24/95 |
| 1,049,902 | 1/1913 | Munger | 24/95 |
| 1,382,739 | 6/1921 | Patremio | 24/113 R |
| 1,718,844 | 6/1929 | White et al. | 24/94 |
| 2,442,362 | 6/1948 | Janes | 24/95 |
| 2,582,383 | 1/1952 | Jones | 24/113 MP |
| 3,316,793 | 5/1967 | Mitchell | 24/94 |
| 3,577,846 | 5/1971 | Perrin | 24/95 |
| 3,928,896 | 12/1975 | Puckett | 24/113 R |

FOREIGN PATENT DOCUMENTS

| | | | |
|---|---|---|---|
| 435519 | 11/1946 | Italy | 24/92 |
| 57-79409 | 5/1982 | Japan . | |
| 831316 | 3/1960 | United Kingdom | 24/113 R |

*Primary Examiner*—Victor N. Sakran

*Attorney, Agent, or Firm*—Hill, Van Santen, Steadman & Simpson

[57] ABSTRACT

A tack member, which is adapted to be joined with a button body for attachment of a button to a garment fabric, has a shank of a hollow and solid combined structure. The shank is composed of a tapering hollow end portion and a solid base portion. The hollow end portion is deformable into a balloon-like shape, radially swelled and axially compressed, as its tip end is forced against a cap of the button body on its inner side during insertion of the shank into a hollow hub of the button body, during which time the solid base portion opposes bending or other deformation.

6 Claims, 6 Drawing Figures

BUTTON

BACKGROUND OF THE INVENTION

1. Field of the Invention

The present invention relates to a button including a button body and a tack member adapted to be joined with the button body for attachment of the button to a garment.

2. Prior Art

A known button comprises a button body and a tack member adapted to be joined with the body for attachment of the button to a garment fabric. In attachment, a tapering end of the tack member's shank is pierced through a garment fabric, and is then forced into a hollow hub of the button body so as to deform the tapering end of the shank, thus securing the latter to the hollow hub of the button body. However, in this prior button the shank of the tack member is solid through its entire length and hence requires relatively great force for the deformation of its tapering end. This great force often causes not only the tack member's shank but also the button body's hollow hub to be inclined; as a result, the button is attached to the garment fabric in an inclined position.

Japanese Utility Model Laid-Open Publication (Kokai) No. 57-79409 discloses a button in which a tack member has a hollow shank so that its tapering end can be deformed with relatively small force. However, because the hollow in the shank extends from its tapering end to its base portion, the shank tends to be easily bent or otherwise deformed in its base portions during insertion of the shank into the hollow hub of the button body. With this arrangement it is difficult to attach the button to a garment fabric in a proper position.

SUMMARY OF THE INVENTION

In a button according to the present invention, a tack member, which is adapted to be joined with a button body for attachment of the button to a garment fabric, has a shank of a hollow and solid combined structure. The shank is composed of a tapering hollow end portion and a solid base portion. The hollow end portion is deformable into a balloon-like shape, axially compressed and radially swelled, as its tip end is forced against a cap of the button body on its inner side during insertion of the shank into a hollow hub of the button body, during which time the solid base portion opposes bending or other deformation.

It is therefore an object of the invention to provide a button in which a tack member's shank can be secured to a button body's hollow hub easily and accurately not only without inclination of either the shank or the hollow hub, but also without bending or other deformation of the shank's base portion.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
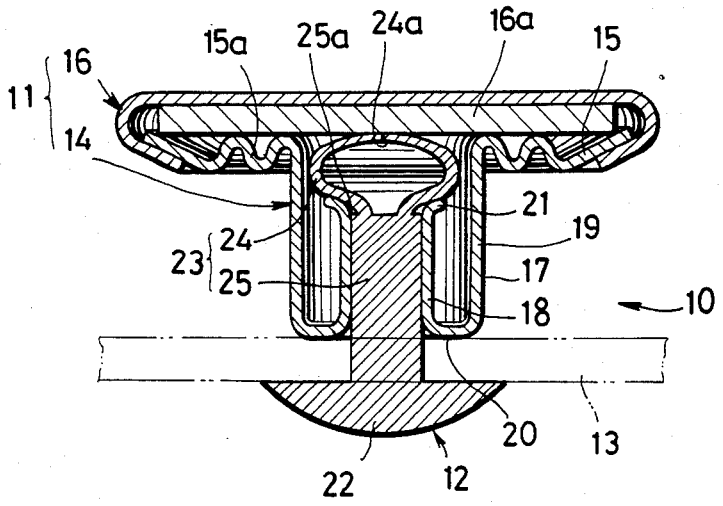
FIG. 1 is a vertical cross-sectional view of a button embodying the present invention, showing the same having been attached to a garment fabric.

The present invention is particularly useful when embodied in a button such as shown in FIG. 1, generally indicated by the numeral 10.

The button 10 comprises a button body 11 and a tack member 12 (joined with the button body 11 in a manner described below), attaching the button 10 to a garment fabric 13. Both the button body 11 and the tack member 12 are preferably made of brass.

Figure 2:
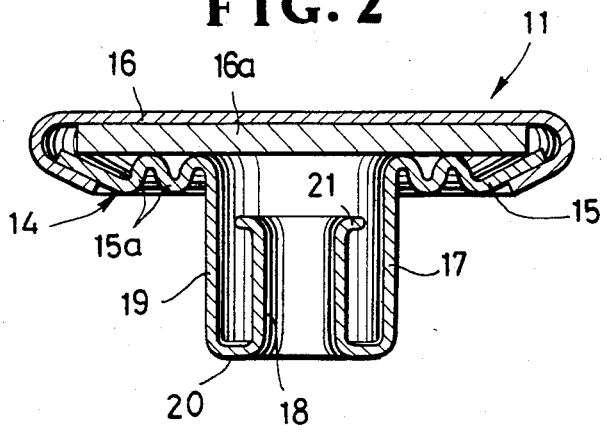
FIG. 2 is a vertical cross-sectional view of a button body.
Figure 2A:
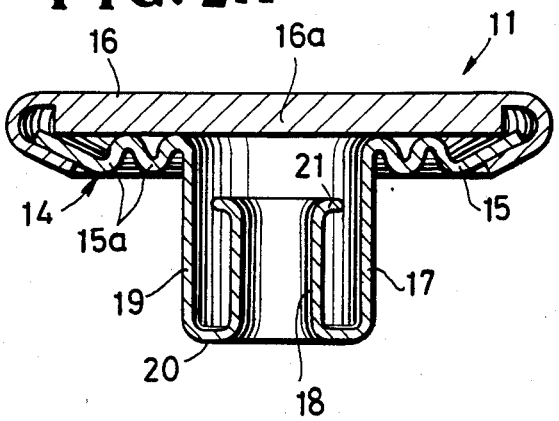
FIG. 2A is a cross-sectional view similar to FIG. 2, showing a modified button body.
Figure 3:
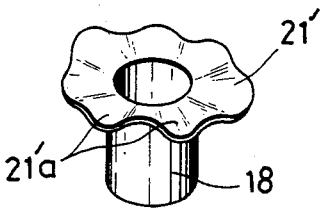
FIG. 3 is a fragmentary perspective view of a modified hollow hub of the button back.

As shown in FIGS. 1 and 2, the button body 11 includes a button back 14 having an annular rim 15 covered by a cap 16. A circular back plate **16*a* is sandwiched between the button back 14 and the cap 16, for a purpose described below. The back plate 16*a* may be an integral part of the cap 16, as shown in FIG. 2A. The button back 14 also has a hollow hub 17 in the form of a double tube of circular cross section projecting downwardly from an inner edge of the annular rim 15. The double-tube hub 17 is composed of a pair of concentric inner and outer tubes 18, 19 joined at their lower end by an annular turn 20. The inner tube 18 has at its upper end an outwardly directed annular flange 21. Alternatively, the inner tube 18 may have a modified flange 21' having a plurality of radial grooves 21'*a*, as shown in FIG. 3. The annular rim 15 of the button back 14 has an annular wavy portion 15*a*** composed of concentric waves.

Figure 4:
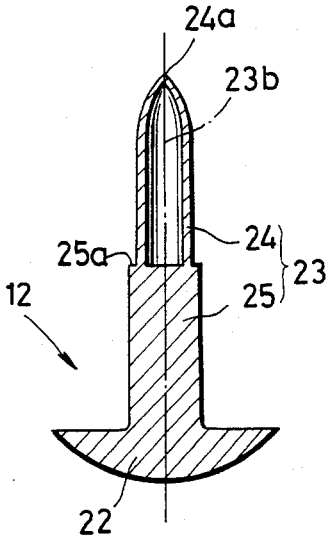
FIG. 4 is a vertical cross-sectional view of a tack member, showing the same before having been secured to the button back.
Figure 5:
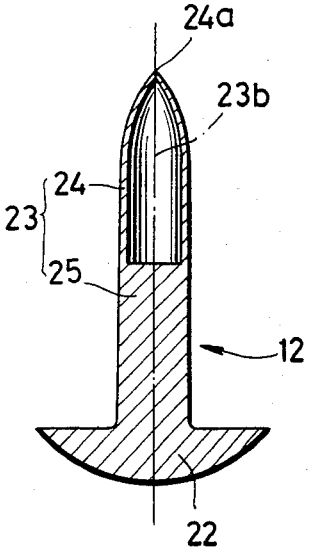
FIG. 5 is a cross-sectional view similar to FIG. 4, but showing a modification of the tack member.

FIG. 4 illustrates the tack member 12 before having been joined with the button body 11 as shown in FIG. 1. The tack member 12 includes a head 22 and a shank 23 of circular cross section projecting perpendicularly and centrally from one face of the head 22 for being inserted through the hollow hub 17 of the button back 14. The shank 23 is composed of a hollow end portion 24 disposed remotely from the head 22, and a solid base portion 25 extending between the head 22 and the hollow end portion 24. The hollow end portion 24 has a progressively decresing diameter toward its tip end **24*a*, and the solid base portion 25 has along its entire length a uniform diameter slightly greater than the maximum outside diameter of the hollow end portion 24 to provide a step 25*a*. Alternatively, the diameter of the solid base portion 25 may be equal to the maximum outside diameter of the hollow end portion 24, as shown in FIG. 5. In production, the tapering hollow end portion 24** may be formed in a known manner, e.g. by drawing a tube of uniform diameter.

Preferably, the length of the solid base portion 25 is such that its upper end is disposed adjacent to the upper end, i.e. the annular flange 21, of the button back's inner tube 17 when the shank 23 is fully inserted through the hollow hub 17 of the button back 14, thus preventing the inner tube 18 from being expanded or otherwise damaged at its upper end portion due to swelling of the hollow shank portion 24. In the embodiment of FIG. 1, the solid shank portion 25 terminates immediately short of the upper end of the inner tube 18. The tip end 24*a* of the hollow end portion 24 is disposed on the center axis 23*b* of the shank 23.

To attach the button 10 to the garment fabric 13, the snak 23 of the tack member 12 of FIG. 4 is pierced through the garment fabric 13 and is then inserted through the inner tube 18 of the button back's hollow hub 17. With continued insertion of the shank 23, the hollow end portion 24 is deformed into a balloon-like shape (FIG. 1) radially, swelled and axially compressed, as its tip end 24*a* is forced against the plate 16*a* disposed between the button back 14 and the cap 16. As a result, the wall of the hollow end portion 24 is bent over and against the annular flange 21 of the hollow hub's inner tube 18 to permanently join the shank 23 of the tack member 12 with the inner tube 18 of the button back's hollow hub 17.

Because of its hollow configuration (FIGS. 4 and 5), the end portion 24 of the shank 23 can be deformed with only relatively small force, making not only the shank 28 but also the button back's hollow hub 17 free from objectionable bending and inclination. Because of its solid configuration, the base portion 25 opposes bending and hence prevents inclination of the shank 23. Further, having a tapering tip end 24*a*, the shank 23 of the tack member 12 can be pierced through the garment fabric 13 smoothly with a minimum amount of force.

With a hollow and solid combined structure, the shank 23 of the tack member 12 can be secured to the hollow hub 17 of the button back 14 easily and accurately, not only without inclination of either the tack member's shank 23 or the button back's hollow hub 17, but also without bending or other deforming of the shank's base portion 25.

With the inner tube 18 having the modified flange 21' of FIG. 3, it is possible to prevent the tack member 12 from being turned or rotated with respect to the button body 11. Moreover, the step 25*a* (FIGS. 1 and 3) of the tack member's shank 23 serves to assist in swelling the hollow end portion 24 uniformly in all directions.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a garment fabric, comprising:

(a) a button body including a button back and a cap covering said button back on its one obverse side, said button back having a hollow hub integral therewith and disposed remotely from said cap and projecting centrally from said button back;

(b) a one-piece tack member including a head, and a shank of a circular cross section projecting perpendicularly and centrally from said head for being pierced through the garment fabric and then inserted into said hollow hub of said button back to thereby join said tack member with said button body; and (c) said shank having a hollow and solid combined structure that is composed of a closed tapering hollow end portion and a solid base portion, said hollow end portion being deformable into a balloon-like shape, axially compressed and radially swelled, as its tip end is forced against the inner side of said cap of said button body during the insertion of said shank into said hollow hub of said button back.

2. A button according to claim 1, said hollow hub of said button back having a pair of concentric inner and outer tubes integral with each other at their one end, said solid base portion having such a length that its end contiguous to said hollow end portion is disposed adjacent to the other end of said inner tube when said shank is fully inserted through said hollow hub.

3. A button according to claim 2, said inner tube having at said other end an outwardly directed annular flange having radial grooves engageable with said hollow end portion when the latter is swelled radially.

4. A button according to claim 1, said hollow end portion of said shank being initially pointed and having a progressively decreasing diameter toward its closed tip end, and said solid base portion having a uniform diameter along its entire length.

5. A button according to claim 4, said one-piece tack member having a diameter at said solid base portion slightly greater than the initial maximum outside diameter at said hollow end portion to provide a step at an end of said solid base portion which end is remote from said head of said one-piece tack member.

6. A button according to claim 4, the diameter of said solid base portion being equal to the maximum outside initial diameter of said hollow end portion.

* * * * *